US008131412B2

(12) United States Patent
Larsson et al.

(10) Patent No.: US 8,131,412 B2
(45) Date of Patent: Mar. 6, 2012

(54) METHOD FOR ARRANGEMENT FOR CALIBRATING A SYSTEM FOR CONTROLLING THRUST AND STEERING IN A WATERCRAFT

(75) Inventors: Anders Larsson, Göteborg (SE); Mathias Lindeborg, Göteborg (SE)

(73) Assignee: CPAC Systems AB, Vastra Frolunda (SE)

( * ) Notice: Subject to any disclaimer, the term of this patent is extended or adjusted under 35 U.S.C. 154(b) by 530 days.

(21) Appl. No.: 12/065,908

(22) PCT Filed: Sep. 6, 2005

(86) PCT No.: PCT/SE2005/111295

§ 371 (c)(1),
(2), (4) Date: Jul. 13, 2009

(87) PCT Pub. No.: WO2007/030040

PCT Pub. Date: Mar. 15, 2007

(65) Prior Publication Data

US 2009/0281685 A1 Nov. 12, 2009

(51) Int. Cl.
*B63H 25/00* (2006.01)

(52) U.S. Cl. ..... 701/21; 440/53; 440/41; 114/55.5; 114/144 R

(58) Field of Classification Search ..... 701/21; 440/53, 41; 114/55.5, 144 R
See application file for complete search history.

(56) References Cited

U.S. PATENT DOCUMENTS 4,691,659 A * 9/1987 Ito et al. ..... 114/144 R
4,747,359 A * 5/1988 Ueno ..... 114/144 B
6,026,783 A 2/2000 Nestvall et al.
6,234,853 B1 * 5/2001 Lanyi et al. ..... 440/53
6,363,875 B1 4/2002 Griffith et al.
6,604,479 B2 8/2003 McKenney et al.
6,704,643 B1 3/2004 Suhre et al.
7,127,333 B2 * 10/2006 Arvidsson ..... 701/2
2001/0015165 A1 * 8/2001 McKenney et al. ..... 114/144 R
(Continued)

FOREIGN PATENT DOCUMENTS

WO 0112505 A1 2/2001
(Continued)

OTHER PUBLICATIONS

International Search Report for corresponding International Application PCT/SE2005/001295.

(Continued)

*Primary Examiner* — Tuan C. To
(74) *Attorney, Agent, or Firm* — WRB-IP LLP

(57) ABSTRACT

In a method for calibrating a system for controlling thrust and steering of a drive arrangement in a watercraft, the system includes an operating device adapted for indicating a requested direction of travel of the watercraft, the operating device being connected to a control unit for providing corresponding thrust and steering commands to the drive arrangement. The method includes receiving an activation command in the control unit, for beginning the calibration, detecting any movements of the operating device, storing values corresponding to the movements in the control unit together with corresponding thrust and steering values, and repeating the detecting step and the storing step until a termination command is received in the control unit, thereby using the stored values in subsequent operation of the operating device for indicating the direction of travel of the watercraft. An arrangement for calibrating a system for controlling thrust and steering of a drive arrangement in a watercraft is also provided.

15 Claims, 6 Drawing Sheets

U.S. PATENT DOCUMENTS

| | | | |
|---|---|---|---|
| 2005/0042951 | A1 | 2/2005 | Morvillo |
| 2005/0159052 | A1 | 7/2005 | Borrett |

FOREIGN PATENT DOCUMENTS

| | | | |
|---|---|---|---|
| WO | 02085702 | A1 | 10/2002 |
| WO | 03026955 | A2 | 4/2003 |

OTHER PUBLICATIONS

International Preliminary Report on Patentability for corresponding International Application PCT/SE2005/001295.
Supplementary European Search Report for corresponding European App. EP 06 77 8271.

* cited by examiner

METHOD FOR ARRANGEMENT FOR CALIBRATING A SYSTEM FOR CONTROLLING THRUST AND STEERING IN A WATERCRAFT

BACKGROUND AND SUMMARY

The present invention relates to a method for calibrating a system for controlling thrust and steering of a drive arrangement in a watercraft, said system comprising an operating device adapted for indicating a requested direction of travel of said watercraft, the operating device being connected to a control unit for providing corresponding thrust and steering commands to said drive arrangement.

The invention also relates to an arrangement for calibrating a system for controlling thrust and steering of a drive arrangement in a watercraft, wherein said system comprises an operating device adapted for indicating a requested direction of travel of said watercraft, the operating device being connected to a control unit for providing corresponding thrust and steering commands to said drive arrangement.

When controlling a watercraft, for example in the form of smaller ships and leisure boats, there is a general need for arrangements which allow a precise control of the thrust and steering of the watercraft. In particular, there is a need for a arrangements providing accurate control of the watercraft during docking. In this regard, the term "docking" refers to a manoeuvre in which a watercraft is propelled towards a harbour, marina or pier in order to be landed and secured.

In certain situations, the docking manoeuvre can be quite difficult for the driver of the watercraft, for example when the watercraft must be landed with one of its sides towards the harbour, for example in a space between two other boats. Such a situation can be simplified if the watercraft is arranged to be propelled in the sideways direction, i.e. in a direction which is generally transverse to the longitudinal direction of the watercraft.

Such a sideways movement of a watercraft can be carried out if the watercraft is provided with two drive arrangements which are separately controllable, i.e. independently of each other. The drive arrangements can for example be in the form of conventional combustion engines which are connected to propellers. By shifting one of the engines into reverse and operating the other engine in forwards drive, while at the same time carefully adjusting the steering angles of the two propellers, the watercraft can be brought to move in a direction which is essentially transverse to its longitudinal direction.

A similar type of docking manoeuvre can also be obtained in watercraft provided with bow thrusters or stern thrusters. A bow thruster comprises a propeller which is mounted in the bow, generally transverse to the longitudinal direction of the watercraft, in order to generate a side force on the bow. In this manner, the watercraft can be more easily controlled when docking or maneuvering at low speeds. A similar arrangement, a so-called stern thruster, can be provided in the stern of a watercraft.

The patent document U.S. Pat. No. 4,519,335 discloses a device for controlling the direction of movement of a watercraft by separately controlling two steerable propellers. For example, the watercraft can be given a thrust in a lateral direction.

However, a docking manoeuvre requires a careful control of the steering and thrust of the engines. It should also be noted that the movements of a watercraft during docking are, to a large extent, determined by the position of the centre of rotation of the watercraft. The centre of rotation is an imaginary point which can be calculated for each watercraft and which defines a vertical axis about which the watercraft may rotate. The fact that the centre of rotation may vary for a certain watercraft means that a control command for steering the watercraft in a certain direction may not always correspond exactly to the direction of the operating device on which the control command is carried out. This problem is further emphasized through the fact that the efficiency for a twin-engine drive arrangement is different in the forwards drive of a propeller as compared with reverse operation.

Consequently, a problem with previously known control systems for watercraft is that they do not allow a steering, for example during docking, in which the movements of a manually operable steering control device correspond precisely to the actual direction of movement of the watercraft. In some cases, a manipulation of a steering control device along a direction which is transverse to the longitudinal direction of the watercraft may in fact lead to a curve-shaped course of travel of the watercraft.

It is desirable to provide a method and arrangement for calibrating an operating device for a watercraft, by means of which the above-mentioned problems can be solved, and which in particular gives an accurate and precise command over the direction of movement of a watercraft.

A method according to an aspect of the present invention comprises the following steps: receiving an activation command in the control unit, for beginning said calibration, detecting any movements of said operating device, storing values corresponding to said movements in the control unit together with corresponding thrust and steering values, and repeating said detecting step and said storing step until a termination command is received in the control unit, thereby using said stored values in subsequent operation of the operating device for indicating said direction of travel of the watercraft.

In an arrangement according to an aspect of the present invention, said control unit is adapted for receiving an activation command from said operating device, indicating a beginning of said calibration, and that said control unit is also adapted for detecting movements of said actuator, for storing values corresponding to said movements in the control unit together with corresponding thrust and steering values, and for repeating said detecting step and said storing step until a termination command is received in the control unit, thereby using said stored values in subsequent operation of the operating device for indicating said direction of travel of the watercraft.

By means of an aspect of the present invention, certain advantages are accomplished. For example, a docking function with the watercraft will be easier to be carried out by its driver, and will be perceived as more accurate. Also, the control unit may control this accurate docking function without having to make complicated calculations as regards the position of the centre of rotation of the watercraft.

BRIEF DESCRIPTION OF DRAWINGS

In the following, the invention will be described with reference to the appended drawings, wherein.

DETAILED DESCRIPTION

Figure 1:
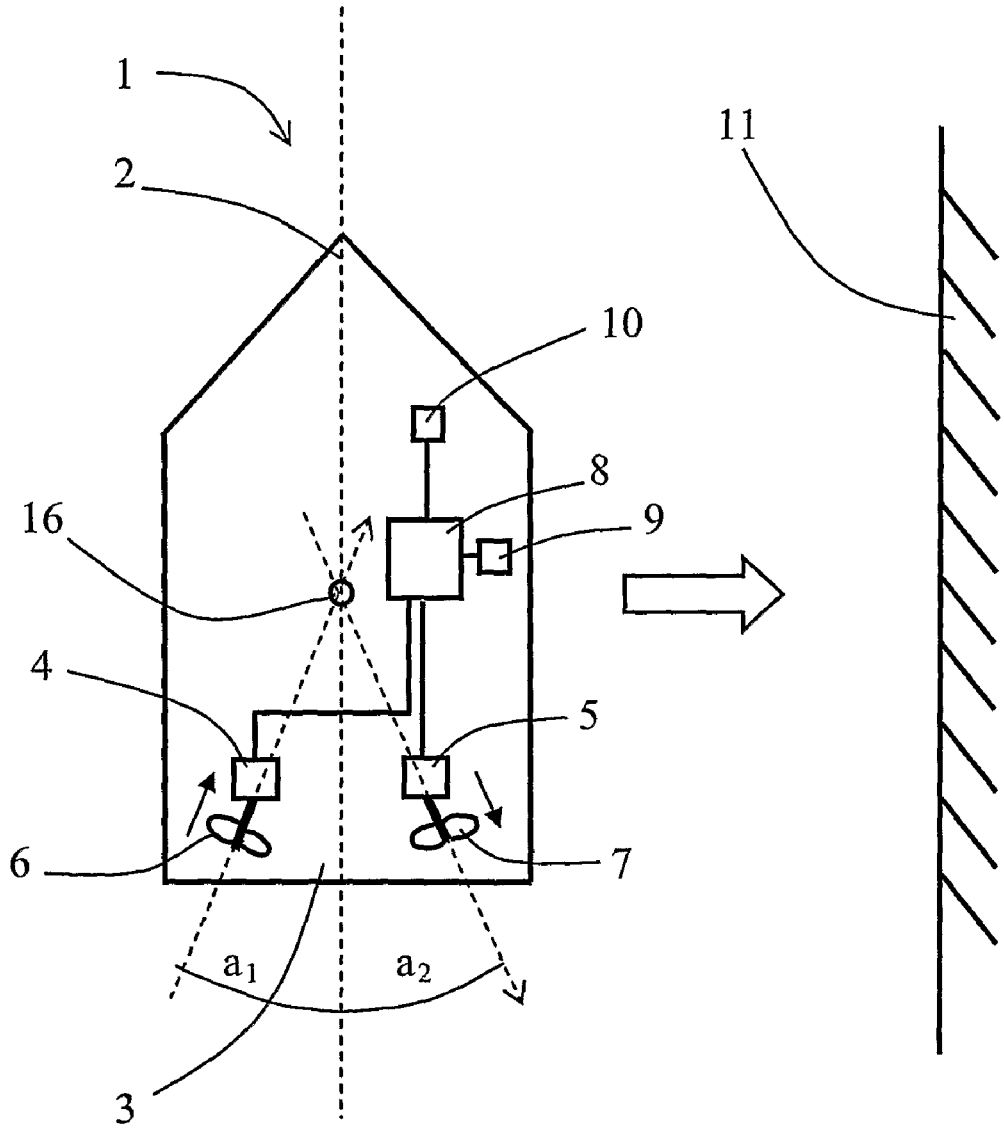
FIG. 1 is a simplified top view of a watercraft being arranged in accordance with the present invention.

FIG. 1 shows a simplified top view of a watercraft 1 in which the present invention can be used. Generally, the invention can be used in any type of watercraft, such as larger commercial ships, smaller watercraft such as leisure boats and other types of water vehicles or vessels. The invention is particularly useful for small leisure boats, but it is nevertheless not limited to such type of water vehicle only.

As indicated schematically in FIG. 1, the watercraft 1 is designed with a bow 2 and a stern 3. In the stern 3, two drive arrangements 4, 5 are mounted. More precisely, the watercraft 1 is provided with a first drive arrangement 4 arranged at the port side and a second drive arrangement 5 arranged at the starboard side. The drive arrangements 4, 5 are generally of conventional kind, for example in the form of combustion engines or any other type of drive units suitable for marine applications. In this embodiment, the drive arrangements 4, 5 are in the form of combustion engines, wherein the first drive arrangement 4 is arranged for driving a first propeller 6 and the second drive arrangement 5 is arranged for driving a second propeller 7.

The two drive arrangements 4, 5 are independently steerable, which means that they are connected to and controllable by means of a control unit 8, which is suitably in the form of a computerized unit for receiving commands from control and steering units, which are indicated schematically by means of reference numeral 9. Such control and steering units are preferably constituted by throttle levers for the engines 4, 5 and a steering wheel. Such units are previously known as such, and for this reason they are not described in detail here. Based on received information from the control and steering units 9, the control unit 8 is arranged to control the first drive arrangement 4 and the second drive arrangement 5 in a suitable manner to propel the watercraft 1 with a requested direction and thrust.

When driving the watercraft 1 under normal operating conditions at sea, i.e. cruising at a given speed, the control unit 8 will receive control commands from the control and steering units 9. However, the driver of the watercraft 1 also has the option of controlling the watercraft 1 by means of a separate operating device 10, preferably in the form of a so-called joystick, which constitutes a second control and steering unit for controlling thrust and steering of the watercraft 1, i.e. the steering angles and engine speeds of the drive arrangements 4, 5. The operating device 10 is primarily intended to be used during docking of the watercraft 1, i.e. during a manoeuvre in which the driver of the watercraft 1 intends to steer it towards a given position at a harbour 11 for the purpose of landing the watercraft 1. In particular, the operating device 10 is useful during a docking manoeuvre in which the watercraft 1 is to be steered in a sideways direction, as will be described below in greater detail.

The invention is generally not limited to be used with an operating device 10 in the form of a joystick, but can be used with other operating devices which are used to receive some form of input signal to indicate a requested course of travel.

The operating device 10 according to the embodiment will now be described in detail with reference to FIG. 2. As mentioned above, the operating device 10 comprises a housing 12 which holds a manually operable lever 13, or a similar activation device. The lever 13 is freely movable in two directions x, y as indicated by means of broken lines in FIG. 2. The x direction is defined as being perpendicular to the y direction. The operating device 10 is electrically connected to the control unit 8 (see FIG. 1) for the purpose of controlling the course and thrust of the watercraft 1. This means that a given position of the lever 13 in the x and y directions is set by the driver of the watercraft 1 in order to choose a particular requested direction of movement of the watercraft 1 and a certain thrust of the watercraft 1. More precisely, the direction to which the lever 13 points corresponding to the desired direction of movement of the watercraft 1, and the inclination of the lever 13 correspond to the thrust provided by the drive arrangements 4, 5.

Figure 2:
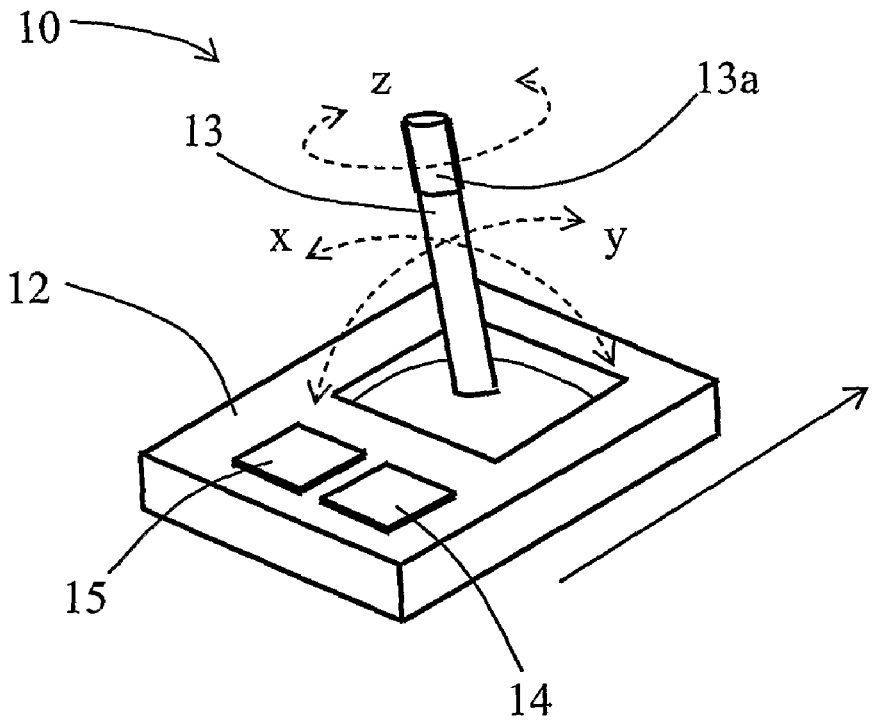
FIG. 2 is a perspective view of a steering control device according to a preferred embodiment of the invention.

Furthermore, according to the embodiment shown in FIG. 2, the lever 13 is arranged with an outer, rotatable section, which is indicated by means of reference numeral 13*a* in FIG. 2. This section 13*a* is arranged to be rotatable independently of the position and inclination of the lever 13. The rotational movement takes place in a longitudinal direction defined as the z direction, i.e. a movement about an imaginary axis which is defined as an extension of the longitudinal direction of the lever 13. The z direction is indicated in FIG. 2 by means of a curved arrow.

Preferably, the rotatable section 13*a* can be rotated in either direction and is preferably also spring-biased so as to return to a neutral position when it is not rotated.

The control unit 8 is generally arranged to convert detected values corresponding to the actual position of the lever 13 (i.e. in the x and y directions) and the rotational position of the rotatable section 13*a* (i.e. in the z direction) into suitable control commands for a steering angle a and engine speed n for each of the drive arrangements 4, 5.

In the embodiment shown in FIG. 2, the longitudinal direction of the operating device 10 corresponds to the y direction, and also to the longitudinal direction of the watercraft 1, as indicated by means of an arrow in FIG. 2. The x direction of the lever 13 corresponds to a direction which is generally transverse to the longitudinal direction of the watercraft 1.

According to the described embodiment, the operating device 10 is intended to be used primarily during a docking manoeuvre. For this purpose, the operating device 10 is provided with a first activating device 14, for example in the form of a push button, which will activate a mode of operation in which the operating device 10 is used (instead of the control and steering units 9 mentioned above). Consequently, by pushing the activating device 14, the control unit 8 is set in "docking mode", i.e. an operating mode in which the drive arrangements 4, 5 are controlled by means of the operating device 10 only. By pushing on the first activating device 14 once again, the "docking mode" is terminated and the control and steering units 9 are used for operating the watercraft 1.

In accordance with the embodiment, the operating device 12 is also provided with a second activating device 15, preferably also in the form of a push button or a similar device. As will be described in greater detail below, the second activating device 15 is used during a calibration procedure according to the invention, i.e. for entering a "calibration mode".

With reference to FIG. 1 again, a docking manoeuvre with the watercraft 1 will now be described. In particular, it will be described that the watercraft 1 is to be docked by steering it sideways towards the harbour 11, i.e. in a direction generally transverse to the longitudinal direction of the watercraft 1. This direction is indicated by means of an arrow in FIG. 1. Before carrying out the docking manoeuvre, the corresponding activating device 14 (see FIG. 2) must be pressed so that "docking mode" is entered. This normally corresponds to a phase when the watercraft approaches its intended position at the harbour.

During docking as shown in FIG. 1, the drive arrangements 4, 5 should be set in an operating condition in which the first drive arrangement 4 is operated in forwards drive with a certain engine speed rvt, whereas the second drive arrangement 5 is operated in reverse with a certain engine speed n2. Here, it should be noted that the watercraft 1 has a particular imaginary vertical axis which constitutes the centre of rotation 16 of the watercraft 1. During docking, the steering angles of the drive arrangements 4, 5 are set so that each direction of force extends through the above-mentioned centre of rotation 16. As indicated in FIG. 1, the first drive arrangement 4 is arranged with a certain angle ai with reference to the longitudinal direction of the watercraft 1, whereas the second drive arrangement is also arranged with a certain angle a2 with reference to the longitudinal direction of the watercraft 1. This means that the direction of force from each drive arrangement extends through the centre of rotation 16, however with opposite directions as indicated with the broken lines in FIG. 1 extending through the centre of rotation 16.

The docking movement is obtained by manipulating the lever 13 (see FIG. 2) on the operating device 10 in generally the same direction as the requested direction of movement of the watercraft 1, i.e. to the right as regarded in FIG. 1 and as indicated by an arrow in FIG. 1. This corresponds to movement of the lever 13 along the x direction as shown in FIG. 2. By operating the drive arrangements 4, 5 in opposite directions and with their respective force acting along a direction extending through the centre of rotation 16, the watercraft 1 will now move sideways towards the harbour 10. This is the direction which corresponds to the resulting force acting from the drive arrangements 4, 5.

Figure 3:
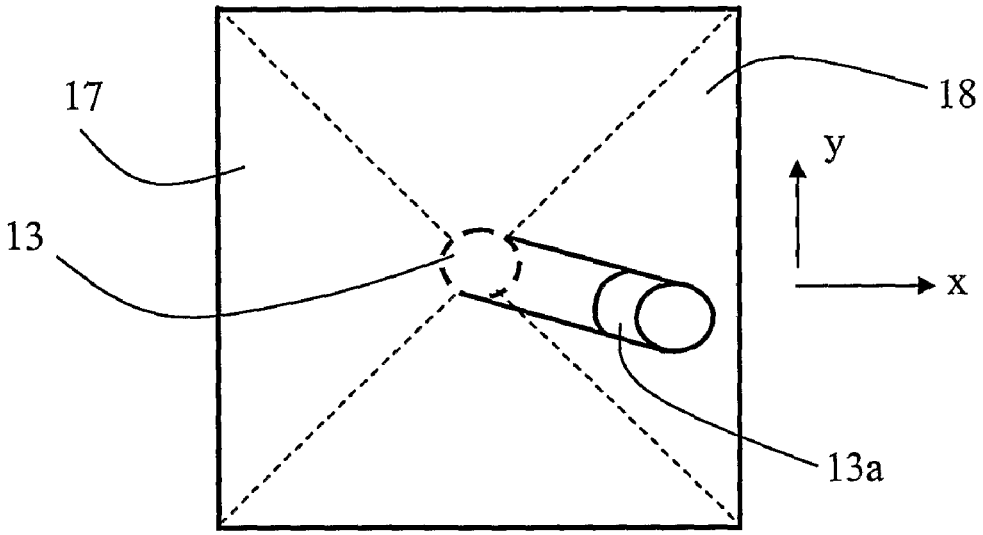
FIG. 3 is a schematical top view showing an example of movements of a lever forming part of the control device.

FIG. 3 shows in a simplified view, regarded from above, the pattern of movement of the lever 13. When inclined towards either side, the lever 13 will be positioned within either a left side zone 17 or a right side zone 18, which are delimited by means of broken lines in FIG. 3. When being positioned within any of these side zones 17, 18, the rotatable section 13*a* can be rotated independently of the position of the lever 13.

As an example only, FIG. 3 shows the position of the lever 13, when tilted to the right and slightly downwards, i.e. within the right side zone 18. It should be mentioned that the left and right zones 13, 14 can be defined in other suitable ways than shown in FIG. 3.

According to the preferred embodiment, the lever 13 is used in the following manner during docking. Firstly, the operating device 10 is preferably used so that when moving the lever 13 in the x and y directions towards any of the sides (left or right), the engine speeds n1, n2 of each of the drive arrangements 4, 5 are affected only, i.e. the angles a1, a2 of the drive arrangements 4, 5 are not affected. Secondly, when the rotatable section 13*a* is rotated, the angles a1, a2 are affected whereas the engine speeds n1, n2 are not.

Consequently, the control unit 8 is arranged to control the engine speeds n1, r2 to suitable values depending on the direction of the lever 13 in the x and y directions, and also to control the angles a1, a2 to suitable values depending on the degree of rotation of the rotatable section 13*a*. This means that during docking, the control unit 8 is arranged to convert the position of the lever 13 and its rotatable section 13*a* to suitable steering angles a and engine speeds n of the two drive arrangements 4, 5 to obtain a direction of travel of the watercraft 1 which corresponds to the actual physical direction of the lever 13. However, as mentioned initially, the actual direction of travel of the watercraft 1 does not always correspond to the same direction of movement of the lever 13. There are several reasons for this. Firstly, the centre of rotation 16 of the watercraft 1 may change continuously, for example depending on the load imposed on the watercraft 1 and the weight distribution along the watercraft 1 as a result thereof. Also, as regards the drive arrangements, the efficiency is normally different during operation in the forwards direction as compared with reverse operation. These factors may contribute to a situation in which the watercraft 1 will in fact not travel in the same direction as the direction to which the lever 13 points. For this reason, a calibration of the control unit 8 together with the operating device 10 and the drive arrangements 4, 5 can be carried out. This will now be described in detail with reference to FIGS. 4*a*-4*e*.

Figure 4A:
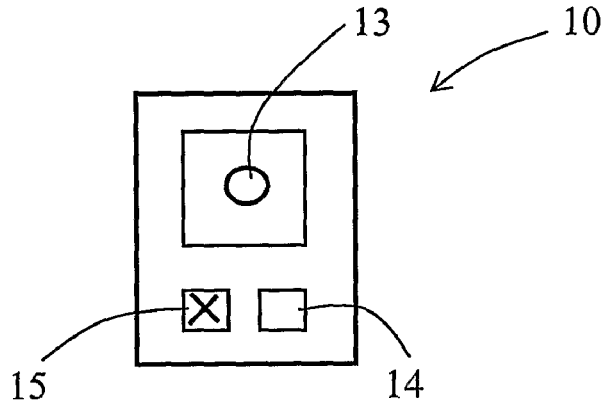
FIGS. 4*a-c* are schematical illustrations of a calibration procedure according to the invention.

With reference initially to FIG. 4*a*, which shows a schematical top view of the operating device 10, a calibration procedure according to the invention is initiated by pressing on the second activating device 15 (see FIG. 2) for a predetermined time period, for example a few seconds. As a result, the system will enter the "calibration mode". Although not shown in the drawings, the operating device 10 can optionally be provided with some type of indicator, for example an light emitting diode, in order to indicate to the driver that the "calibration mode" has been entered.

At this initial stage, the lever 13 is shown in an unaffected condition, which means that it is positioned in the centre of its range of movement, in which x=y=0. Also, the rotatable section 13*a* is not affected at this stage.

Figure 4B:
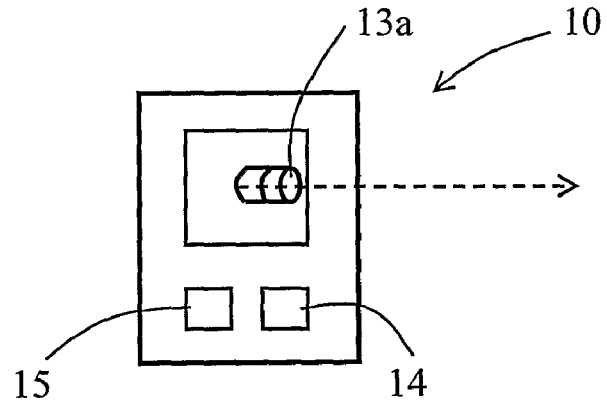

The purpose of the calibration is to ensure that a movement of the lever 13 in a direction as shown in FIG. 4*b*, i.e. straight to the right as indicated by an arrow, also corresponds to movement of the watercraft 1 in the same direction, i.e. straight to the right as shown FIG. 1. Since the operating device 10 has now entered the "calibration mode" after pushing on the second activating device 15, the watercraft 1 is controlled by means of the lever 13 with the aim of steering the watercraft 1 in the intended direction (i.e. straight to the right, in this particular case). For this reason, the driver now starts the actual calibration by manually setting the lever 13 as shown in FIG. 4*b*, i.e. straight to the right. The watercraft now starts to move in generally the same direction.

The driver of the watercraft 1 now has to adjust the steering and thrust commands in order to compensate due to variations in the centre of rotation 16, due to differences in efficiency of the drive arrangements 4, 5 in forwards drive as compared with reverse drive, etc. Normally, this means that the lever 13 must be adjusted with small corrections as regards its inclination and direction during a certain time period. Also, the rotation of the rotatable section 13 can be adjusted during this stage.

Figure 4C:
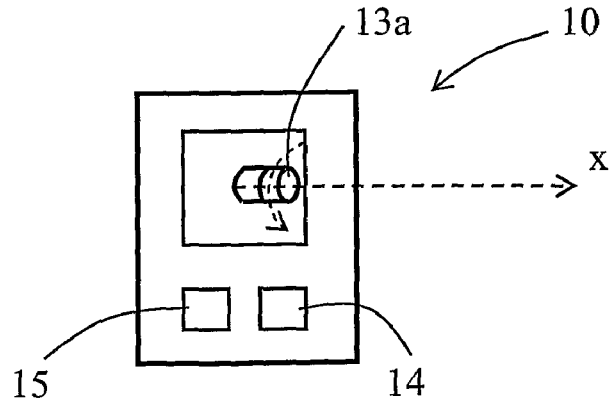

As an example, shown in FIG. 4*c*, it can be assumed that during the calibration, the driver of the watercraft notices that the watercraft starts to rotate slightly. This movement of the watercraft can be counteracted by rotating the rotatable section 13. In particular, since the amount of rotation of the rotatable section 13 affects the steering angles, such a rotation will cause the angles a1, a2 of the drive arrangements 4, 5 to be changed. The control unit 8 is arranged so as to change these angles a1, a2 to suitable values so that the rotations is eliminated. Preferably, the control unit 8 is arranged to change the angles a1, a2 with the same amount, for example by increasing the first angle a1 from 15° to 20°, and by increasing the second angle a2 also from 15° to 20°. The invention is of course not limited to such an example only. In principle, the control unit 8 can be programmed in any suitable manner so that the drive arrangement angles respond to movement of the rotatable section 13 in the desired manner so that rotation of the watercraft is eliminated.

Figure 4D:
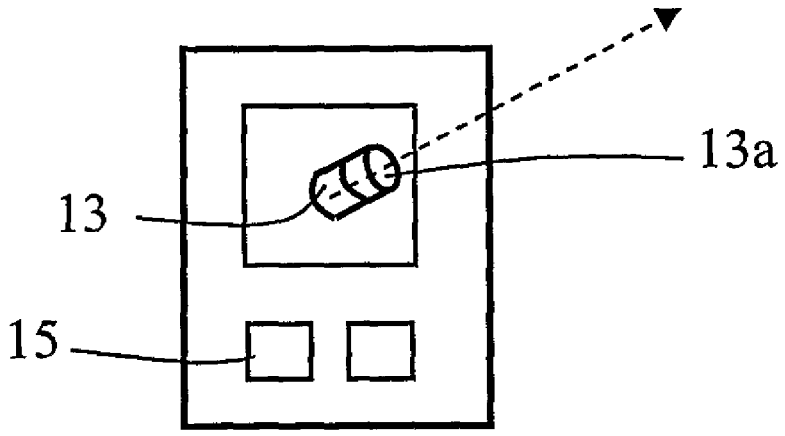

After having eliminated the rotation of the watercraft, it may for example be assumed that the driver notices that the watercraft moves slightly diagonally, i.e. not straight to the right as desired. In such case, the lever 13 should be manipulated with a suitable direction and inclination in order to eliminate this tendency of diagonal movement. This is shown in FIG. 4*d*, which indicates that the lever has been moved by the driver in a certain direction as indicated as an example by means of a broken line. This is carried out while maintaining the rotation of the rotatable section 13*a*. As mentioned above, the control unit 8 is arranged so that the movements of the lever in the x and y directions causes corresponding changes of the engine speeds n1, n2. Preferably, the control unit 8 is arranged to control the difference in engine speed, i.e. ?n=n1−n2, instead of the actual speeds n1, n2 of each drive arrangement. The reason for this is that, normally, the drive arrangements present different efficiency in forward gear as compared with reverse gear.

Consequently, when the driver wishes to eliminate the diagonal movement of the watercraft, the lever 13 is moved in a suitable direction and, as a result, the control unit 8 will change the difference ?n in engine speed of the drive arrangements. For example, during movement of a watercraft straight to the side it may be suitable with an engine speed difference ?n which is of the magnitude 100-200 rpm. When the course is to be changed during calibration, as a result of any occurring, undesired, diagonal movement, it may be suitable to increase this difference ?n=n1−n2, which forces the watercraft to move forwards, or alternatively to decrease the difference ?n=n1−n2, which forces the watercraft rearwards.

Figure 4E:
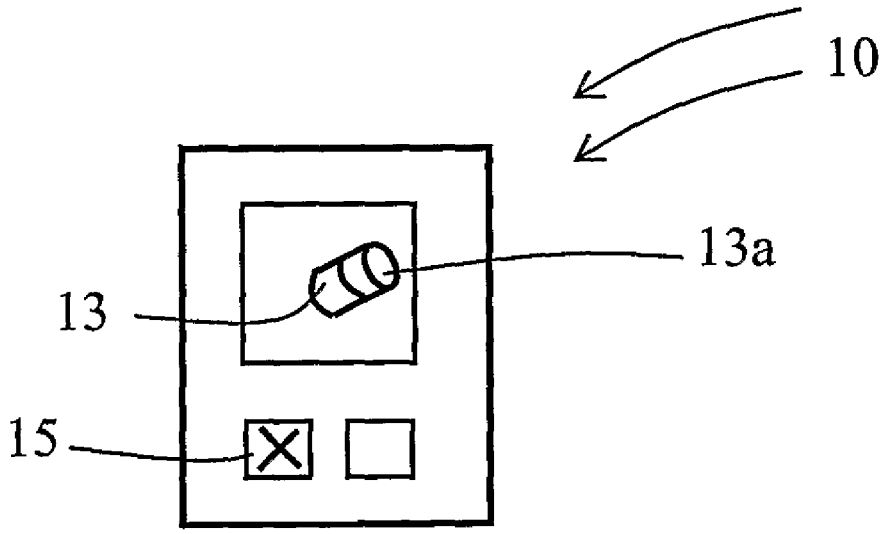

Eventually, the driver has compensated for the various above-mentioned factors and has achieved a movement of the watercraft 1 which is more or less exactly along the course as originally intended. At this stage, the second activating device 15 is once again depressed. This is shown in FIG. 4*e*. This informs the control unit 8 of the fact that the course of the watercraft 1 is correct and that "calibration mode" is now terminated. During the course of the "calibration mode", data from the operating device 10 regarding its position is transmitted to the control unit 8 and is also stored in the control unit 8. In particular, values indicating the inclination and the direction of the lever 13, and also values indicating the rotational position of the rotatable section 13*a*, are stored in a generally continuous manner, suitably at a number of times per second. For each time these values are stored, further values are stored which correspond to the steering angles ai, a2 of the drive arrangements 4, 5. Also, values related to the engine speeds n1, n2 of the drive arrangements 4, 5 are stored. According to a preferred embodiment of the invention, the difference in engine speed, i.e. ?n=n1−n2 is also calculated as mentioned above.

The calibration process is maintained until the driver has obtained a direction of travel for the watercraft 1 which corresponds to the direction of the lever 13. This means that a number of "adjustments" of course and speed are stored during this process. This means that each position of the lever 13, including the rotatable section 13*a* during the "calibration mode", and values representing the steering angles a1, a2 and the engine speed difference ?n, are stored in the control unit 8. The "calibration mode" is terminated by pressing on the second push button 15. After that, the control unit 8 will use the stored information at subsequent occasions when docking is to be carried out. In particular, the next subsequent time the driver of the watercraft 1 activates the operating device 10 (by pressing on the first activating device 14), any movement straight to the right of the lever 13 will cause the control unit 8 to use the previously stored values of the steering angles a1, a2 and the engine speed difference ?n which reflect the above-mentioned "adjustments" of the course. In this manner, a movement of the lever 13 in the correct direction will correspond exactly to the movement of the watercraft 1.

It should be noted that the main cause of the problem on which the invention is based, i.e. that the direction of the actuator may not correspond to the direction of travel of the watercraft, is due to changes in the centre of rotation of the watercraft. However, by means of the invention, there is no need to actually calculate and update the position of the centre of rotation, which is a complicated matter. Instead, the necessary information related to the centre of rotation is provided in an experimental manner during the "calibration mode". This is an important advantage of the invention.

Preferably, the control unit 8 is arranged to calculate suitable engine speeds and drive arrangement angles in the case when a subsequent docking is to be carried out in another direction than that direction in which the calibration process was carried out. This means that calibration only has to be carried out in one single direction. Data from that calibration process can be converted to new control commands (engine speeds, drive angles) which corresponds to any subsequent steering direction to be indicated by means of the lever 13.

Figure 5:
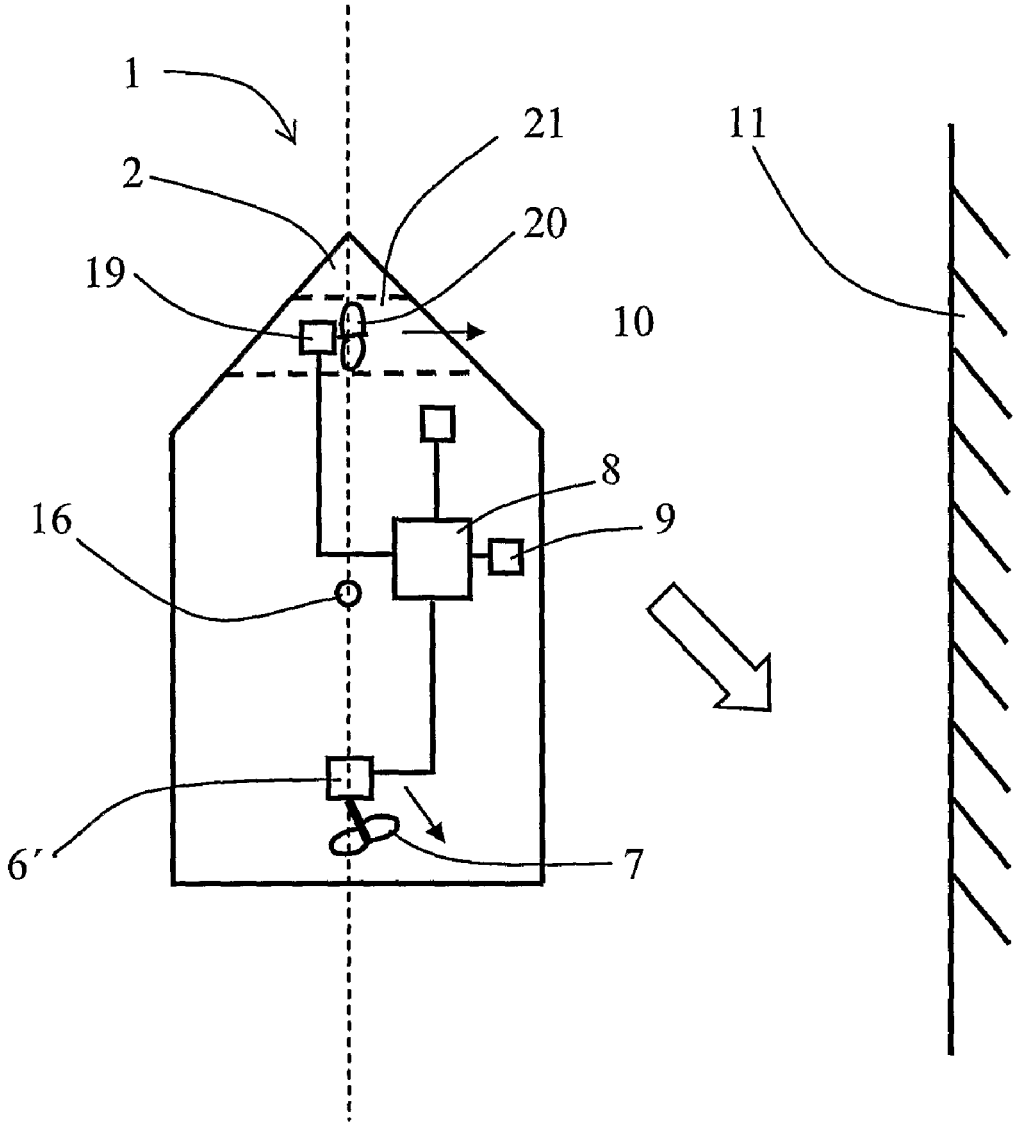
FIG. 5 is a schematical view of an alternative type of watercraft in which the invention can be used.

In FIG. 5, an alternative embodiment of the invention is described. This embodiment relates to a watercraft 1' of the type which comprises a so-called bow thruster 19, i.e. a drive arrangement with a propeller 20 which is mounted in the bow 2 in a manner which is generally transverse to the longitudinal direction of the watercraft. Suitably, the bow thruster 19 and its propeller 20 is mounted in a tunnel 21 which extends transverse to the longitudinal direction of the watercraft 1'. The purpose of the bow thruster 19 is to generate a side force on the bow 2 during docking. In this manner, the watercraft can be more easily controlled when docking or maneuvering at low speeds.

According to a further embodiment, which is not shown in the drawings, a similar arrangement can be provided in the stern of a watercraft, a so-called stern thruster.

The present invention can be implemented in watercraft comprising a bow thruster or a stem thruster, or in watercraft comprising both a bow thruster and a stern thruster.

As shown in FIG. 5, the watercraft 1' is provided with a bow thruster 19 and also with a rear-mounted single drive arrangement 6'. Such an arrangement can also be used for docking at a harbour 11. However, with this particular drive system, the docking can only be carried out while travelling along a slightly diagonal direction, as shown in FIG. 5. This is due to the fact that the drive arrangement 6' cannot normally be positioned to propel the watercraft in a direction straight to the side.

The above-mentioned principles relating to docking and the maneuvers during the "calibration mode" apply also to the embodiment shown in FIG. 5.

In particular, it can be noted that the rotatable section 13*a* of the lever 13 is used to control and counteract any tendency of rotation of the watercraft 1', which is suitably carried out by controlling the speed of the propeller 20 of the bow thruster 19. Also, a movement of the lever 13 in the x and y direction is used to control and counteract any undesired diagonal movement of the watercraft 1', which is suitably obtained by controlling the angle of the rear drive arrangement 6'.

The present invention is not limited to the above-mentioned embodiment, but can be varied within the scope of the appended claims. For example, the invention is suitable for all watercraft which are provided with at least two independently controllable drive arrangements. Also, the operating device 10 can be implemented in other ways than as a joystick. Furthermore, the activating devices 14, 15 can be implemented by means of other components than push buttons.

The invention claimed is:

1. A method of calibrating a system for controlling thrust and steering of a drive arrangement in a watercraft, the system comprising an operating device adapted for indicating a requested direction of travel of the watercraft, the operating device being connected to a control unit for providing corresponding thrust and steering commands to the drive arrangement, wherein the method comprises the steps of:

receiving an activation command in the control unit, for beginning the calibration, detecting any movements of the operating device, storing values corresponding to the movements in the control unit together with corresponding thrust and steering values, and repeating the detecting step and the storing step until a termination command is received in the control unit, thereby using the stored values in subsequent operation of the operating device for indicating the direction of travel of the watercraft, wherein the calibrating is carried out during a docking manoeuvre for the watercraft, and the step of detecting movements of the operating device comprises detecting movements in two perpendicular directions and detecting rotational movements about a longitudinal direction and whereby the operating device comprises a joy-stick arrangement.

2. A method according to claim 1, wherein movements of the operating device in the perpendicular directions is used for controlling the thrust values.

3. A method according to claim 1, wherein movements of the operating device about the longitudinal direction is used for controlling the steering values.

4. A method according to claim 1, wherein the detecting and storing steps are repeated generally continuously until the termination command is received.

5. A method according to claim 1, wherein the value corresponding to the thrust comprises the difference in engine speed between two engines forming part of the drive arrangement.

6. An arrangement for calibrating a system for controlling thrust and steering of a drive arrangement in a watercraft, wherein the system comprises an operating device adapted for indicating a requested direction of travel of the watercraft, the operating device being connected to a control unit for providing corresponding thrust and steering commands to the drive arrangement, wherein the control unit is also an activation command from the operating device configured to indicate, indicating a beginning of the calibration, and the control unit is also configured during the calibration to detect movements of an actuator, to store corresponding to the movements in the control unit together with corresponding thrust and steering values, and to continue said the calibration until a termination command is received in the control unit, thereby using the stored values in subsequent operation of the operating device for indicating the direction of travel of the watercraft, and wherein the operating device comprises a joystick arrangement, being adjustable in two perpendicular directions and also being arranged for being rotated along its longitudinal direction, and the calibrating is carried out during a docking manoeuvre for the watercraft.

7. An arrangement according to claim 6, wherein the operating device is arranged so that movement in the perpendicular directions is used for controlling the thrust values.

8. An arrangement according to claim 6, wherein the operating device is arranged so that movement along the longitudinal direction is used for controlling the steering values.

9. Arrangement according to claim 6, wherein the drive arrangement comprises at least two engines having corresponding propellers, the engines being independently controllable by means of the control unit.

10. A method according to claim 2, wherein movements of the operating device about the longitudinal direction is used for controlling the steering values.

11. A method according to claim 2, wherein the detecting and storing steps are repeated generally continuously until the termination command is received.

12. A method according to claim 2, wherein the value corresponding to the thrust comprises the difference in engine speed between two engines forming part of the drive arrangement.

13. An arrangement according to claim 7, wherein the operating device is arranged so that movement along the longitudinal direction is used for controlling the steering values.

14. Arrangement according to claim 7, wherein the drive arrangement comprises at least two engines having corresponding propellers, the engines being independently controllable by means of the control unit.

15. Arrangement according to claim 8, wherein the drive arrangement comprises at least two engines having corresponding propellers, the engines being independently controllable by means of the control unit.

* * * * *